US007334926B2

(12) United States Patent
Takada

(10) Patent No.: US 7,334,926 B2
(45) Date of Patent: Feb. 26, 2008

(54) VEHICLE HEADLAMP

(75) Inventor: Kenichi Takada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 37 days.

(21) Appl. No.: 11/285,277

(22) Filed: Nov. 23, 2005

(65) Prior Publication Data

US 2006/0114688 A1 Jun. 1, 2006

(30) Foreign Application Priority Data

Nov. 26, 2004 (JP) ..... P.2004-342742

(51) Int. Cl.
*F21V 7/00* (2006.01)

(52) U.S. Cl. ..... 362/517; 362/518; 362/539

(58) Field of Classification Search ..... 362/517, 362/518, 538, 539, 297, 346, 298, 299, 302, 362/303, 304, 351
See application file for complete search history.

(56) References Cited

U.S. PATENT DOCUMENTS 6,543,910 B2 * 4/2003 Taniuchi et al. ..... 362/297
6,921,188 B2 * 7/2005 Taniuchi ..... 362/517
7,008,094 B2 * 3/2006 Taniuchi ..... 362/539
7,044,624 B2 * 5/2006 Taniuchi ..... 362/539

FOREIGN PATENT DOCUMENTS

JP 5-159603 A 6/1993

* cited by examiner

*Primary Examiner*—Thomas M. Sember
(74) *Attorney, Agent, or Firm*—Sughrue Mion, PLLC

(57) ABSTRACT

A vehicle headlamp, for projecting light forward along an optical axis extending in a longitudinal direction of the vehicle, is provided with a light source, a first main reflector, a second main reflector, a shade, and a projection lens. The light source emits light. The first main reflector is arranged above the light source and reflects the light emitted from the light source toward the optical axis. The second main reflector is arranged below the light source and reflects the light emitted from the light source toward a direction different from the optical axis. The shade cuts a part of the light reflected by the first main reflector to form a cut-of line. The projection lens is arranged in front of the first main reflector and forward projects the light having passed the shade.

6 Claims, 10 Drawing Sheets

VEHICLE HEADLAMP

The present application claims foreign priority based on Japanese Patent Application No. P.2004-342742, filed on Nov. 26, 2004, the contents of which are incorporated herein by reference.

BACKGROUND OF THE INVENTION

1. Field of the Invention

The present invention relates to a large quantity of light type headlamp for use in a vehicle.

2. Related Art

There is a vehicle headlamp for projecting light ahead of the vehicle using a projector type of lamp unit.

Such a projector type of lamp unit serves to forward collect/reflect the light emitted from a light source, arranged in the vicinity on an optical axis extending in a longitudinal direction of the vehicle, toward the optical axis by a reflector, and project the reflected light ahead of the lamp unit through a projection lens arranged in front of the reflector. When a distributed light pattern having a cut-off line on the upper end is formed using this lamp unit, a shade is arranged in the vicinity of the focal point on the rear side of the projection lens and a part of the reflected light from the reflector is cut or shielded to form the cut-off line. (For example, JP-A-05-159603 discloses a vehicle headlamp of this type.)

In recent years, as a vehicle headlamp equipped with the projector type lamp unit, its large quantity of light type thereof has been demanded. Generally, with respect to the light emitted from the light source, reflected by the reflector and incident on the projection lens, the vehicle headlamp equipped with the projector type lamp unit makes effective light projected forward by the projection lens.

However, for example, the light which is incident on the lower side of the reflector and cut by the shade results in the lost light which cannot contribute to distributed light to be projected forward. Further, the light which is not incident on the reflector but goes outward directly from the light source or the light which is incident on the area other than the reflector and makes diffused reflection within the lamp unit results in the lost light which cannot contribute to distributed light. Thus, the general projector type lamp unit makes a large quantity of lost light which cannot contribute to the distributed light to be projected forward. Therefore, effective use of this lost light is demanded.

SUMMARY OF THE INVENTION

One or more embodiments of the present invention provide a headlamp which can reduce lost light incapable of contributing to distributed light thereby to project a large quantity of light forward without changing the output of a light source.

In accordance with one or more embodiments of the present invention, a vehicle headlamp is provided with: an optical axis extending in a longitudinal direction of the vehicle; a light source for emitting light; a first main reflector arranged above the light source, for reflecting the light emitted from the light source toward the optical axis; a second main reflector arranged below the light source, for reflecting the light emitted from the light source toward a direction different from the optical axis; a shade for cutting a part of the light reflected by the first main reflector to form a cut-off line; and a projection lens arranged in front of the first main reflector, for forward projecting the light having passed the shade.

In addition, in accordance with one or more embodiments of the present invention, the vehicle headlamp may be further provided with: a first sub-reflector arranged above the first main reflector, for forward reflecting the light emitted from the light source.

In addition, in accordance with one or more embodiments of the present invention, the vehicle headlamp may be further provided with: a second sub-reflector arranged above the second main reflector, for forward reflecting the light emitted from the light source.

In addition, in accordance with one or more embodiments of the present invention, the vehicle headlamp may be further provided with: a third sub-reflector arranged on at least one of the forward right side and forward left side of the first main reflector, for rearward reflecting the light emitted from the light source; and a fourth sub-reflector for forward reflecting the light reflected by the third sub-reflector.

In addition, in accordance with one or more embodiments of the present invention, the vehicle headlamp may be further provided with: a fifth sub-reflector arranged in front of the first main reflector, for downward reflecting the light emitted from the light source; and a sixth sub-reflector for forward reflecting the light reflected by the fifth sub-reflector.

According to the one or more embodiments of the present invention, since the second main reflector and the first to sixth sub-reflectors are arranged around the first main reflector, the light not projected forward as the lost light in the conventional projector type vehicle headlamp can be projected as effective light forward of the vehicle. Thus, without improving the output of the light source, the output of the vehicle headlamp can be increased, thereby providing a large quantity of light type vehicle headlamp.

Moreover, since projected areas of the second main reflector and first to sixth sub-reflectors are set in various manners, the light can be projected to the side not illuminated by only the first main reflector, thereby enhancing side visibility; or otherwise the light quantity at the center of the distributed pattern can be increased, thereby enhancing far distance visibility.

Other aspects and advantages of the invention will be apparent from the following description and the appended claims.

REFERENCE NUMERALS AND CHARACTERS

Figure 1:
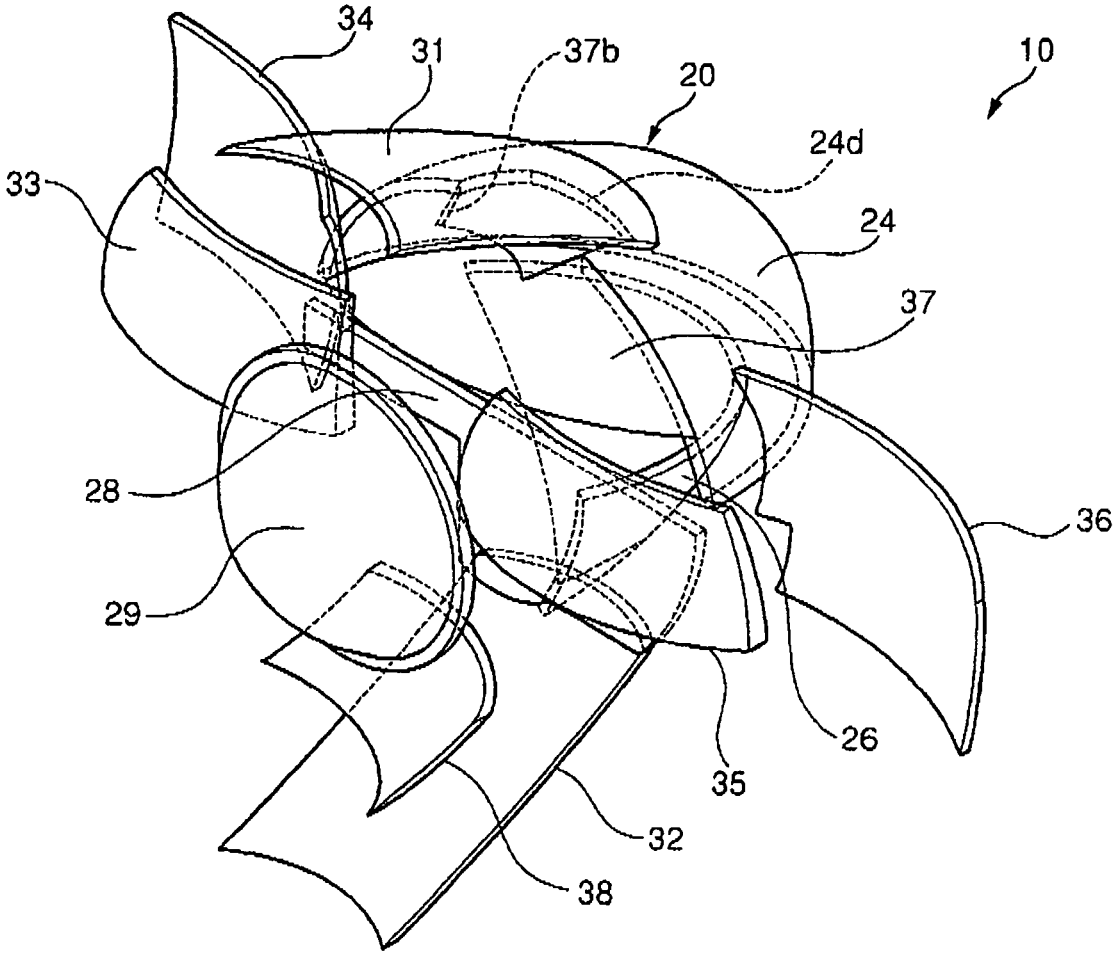
FIG. 1 is a perspective view of the overall appearance of a vehicle headlamp.

Note, in the drawings, the reference numeral 10 is a vehicle headlamp; 20 is a lamp unit; 22 is a light source bulb; 22*a* is a light source; 24 is a first main reflector; 26 is a second main reflector; 28 is a shade; 29 is a projection lens; 31 is a first sub-reflector; 32 is a second sub-reflector; 33 is a right third sub-reflector; 34 is a right fourth sub-reflector; 35 is a left third sub-reflector; 36 is a left fourth sub-reflector; 37 is a fifth sub-reflector; and 38 is a sixth sub-reflector, and the character Ax is an optical axis.

DESCRIPTION OF THE PREFERRED EMBODIMENTS

Embodiments of the invention will be described with reference to the accompanying drawings.

Figure 2:
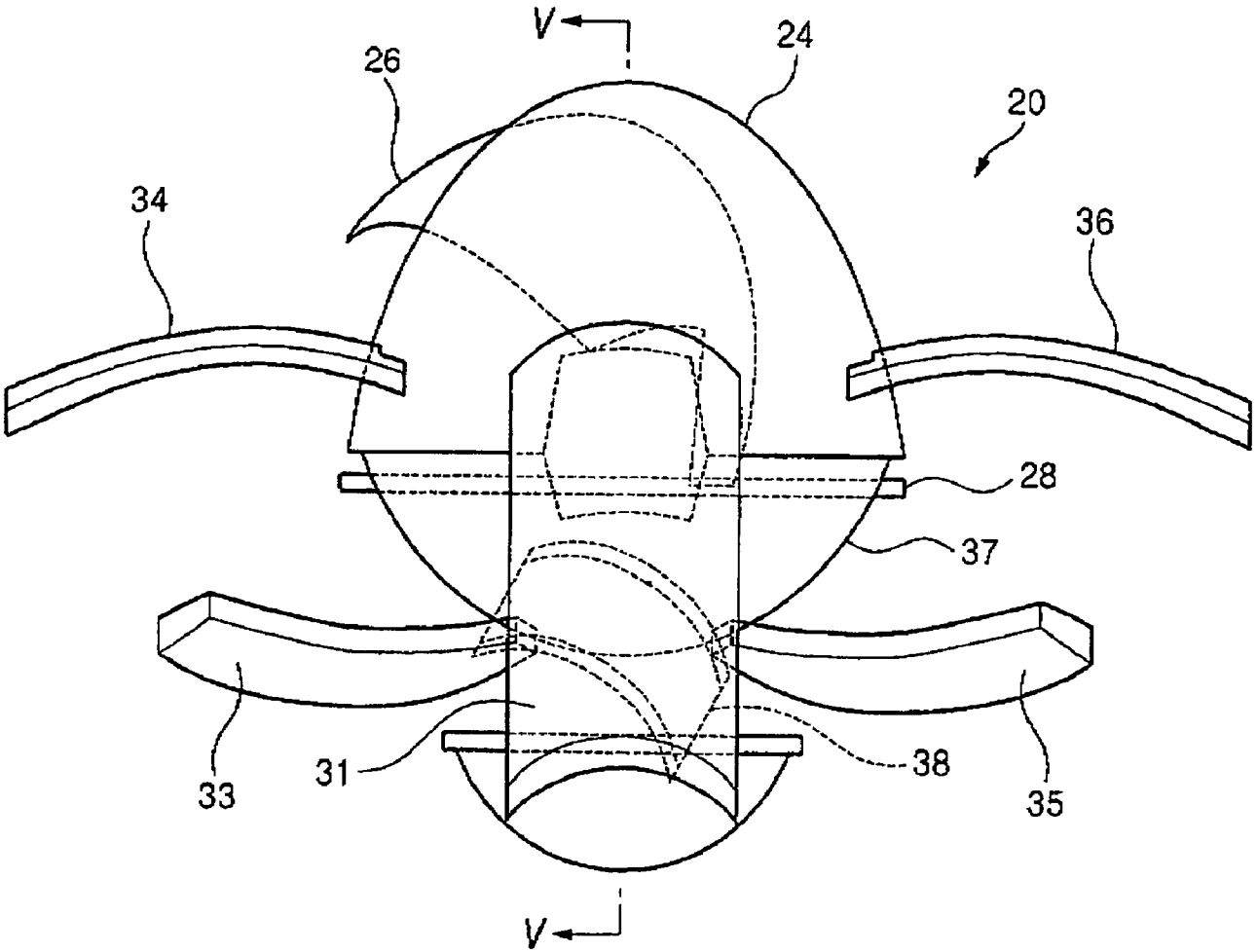
FIG. 2 is a top view of the vehicle headlamp.
Figure 3:
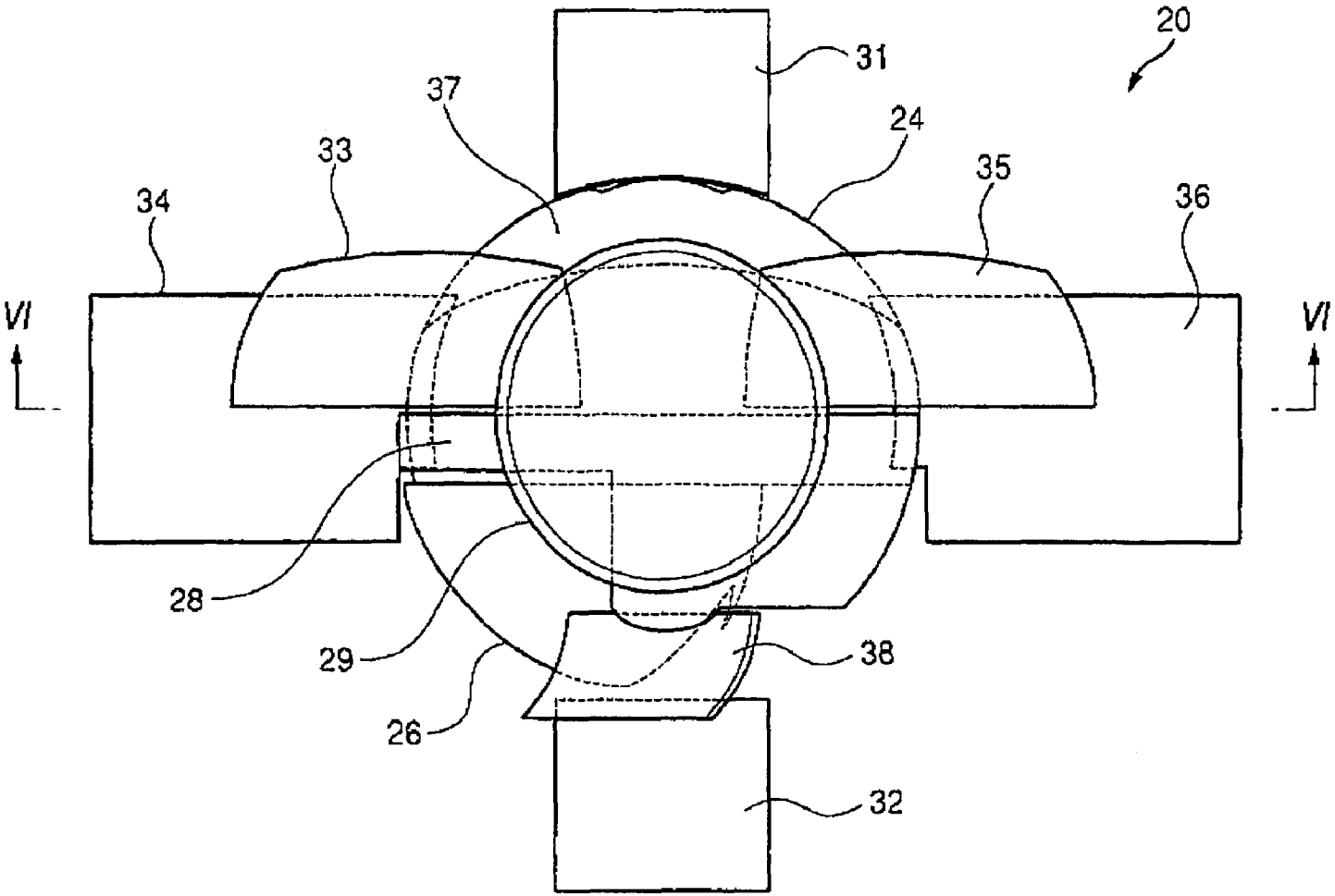
FIG. 3 is a front view of the vehicle headlamp.
Figure 4:
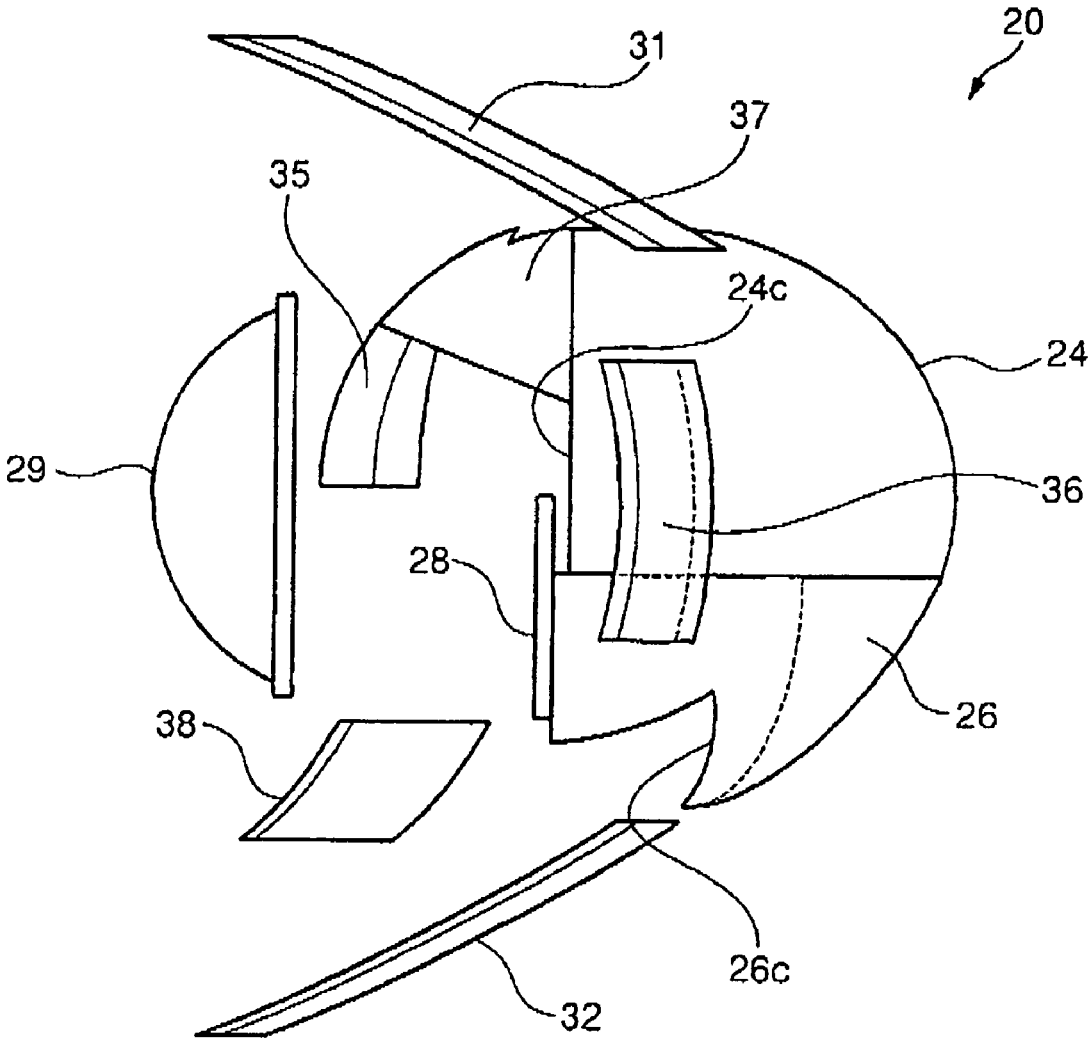
FIG. 4 is a side view of the vehicle headlamp.
Figure 5:
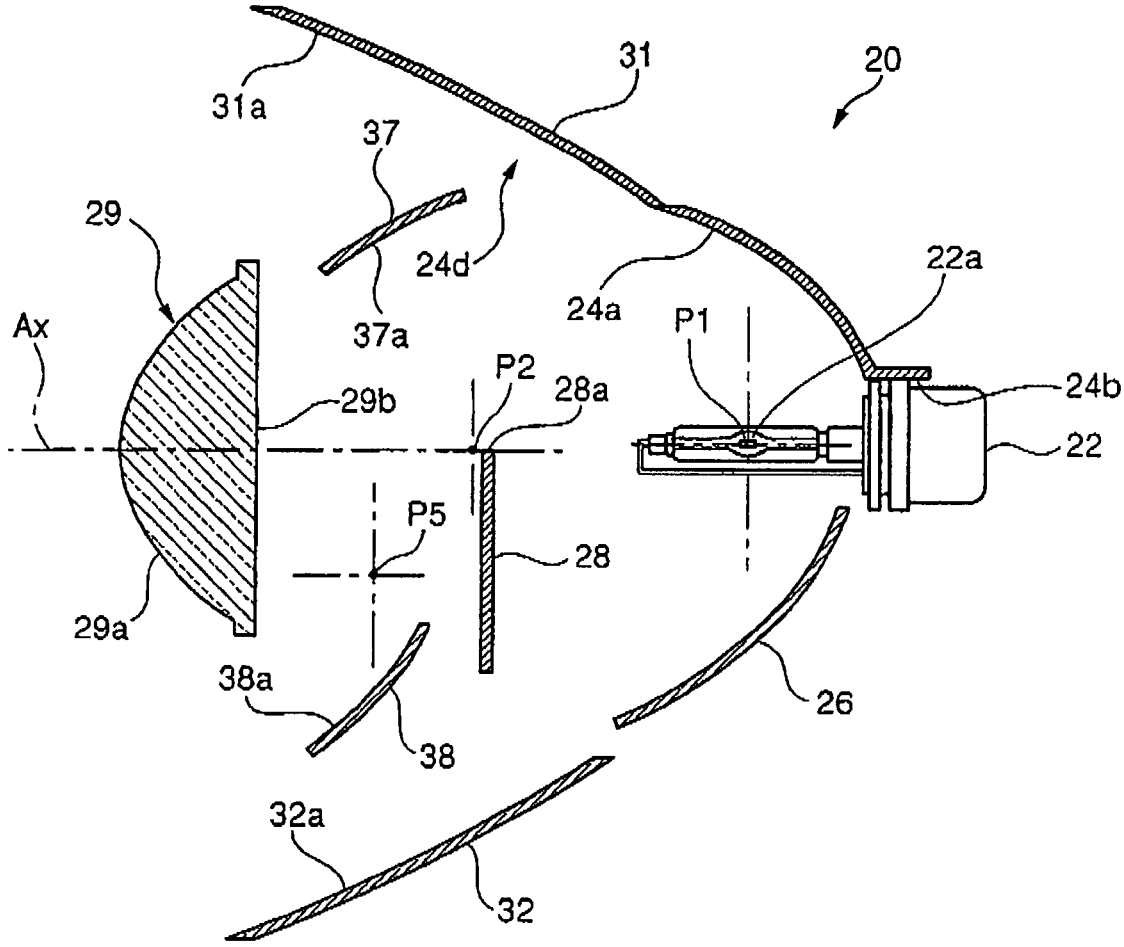
FIG. 5 is a sectional view taken in line V-V in FIG. 2.
Figure 6:
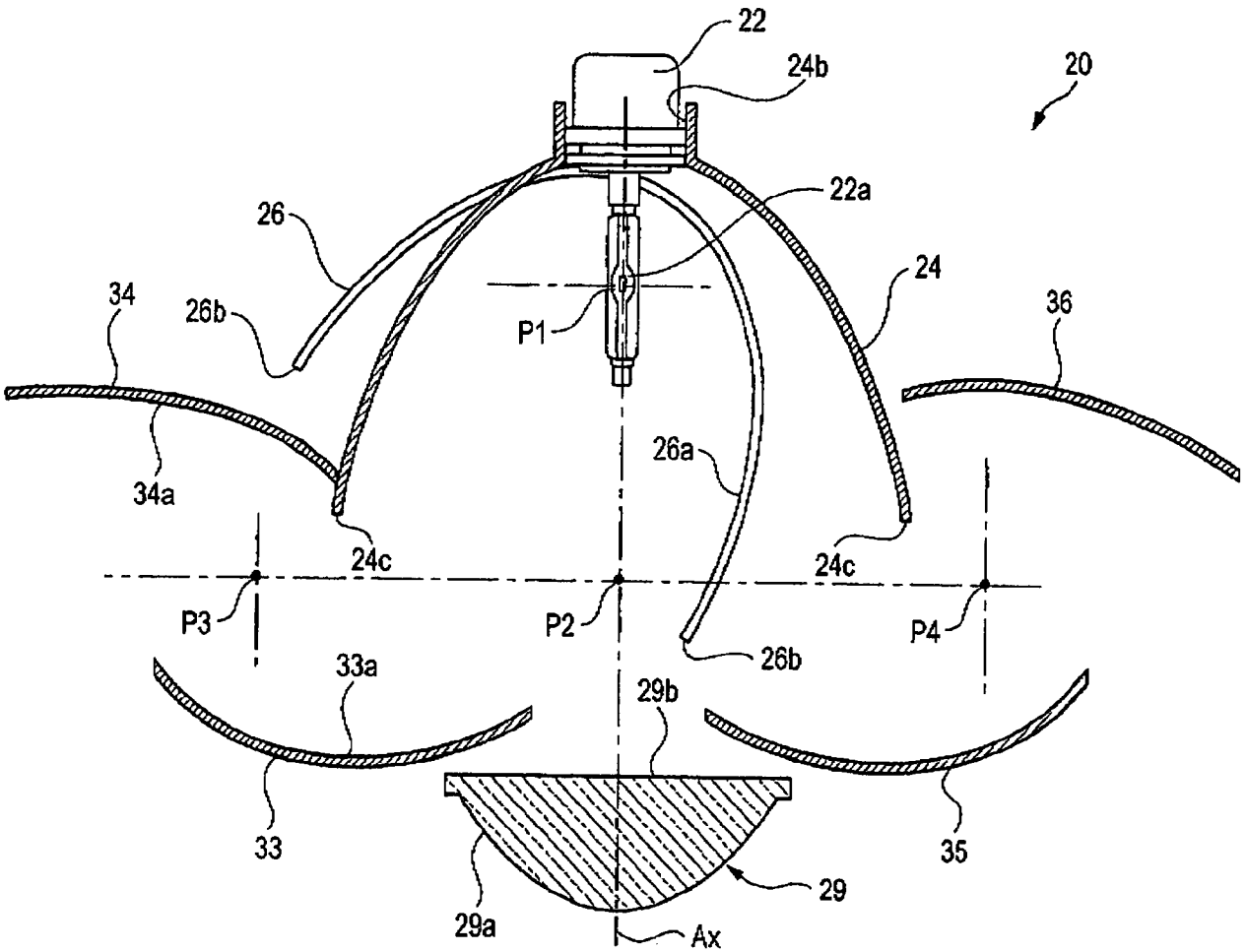
FIG. 6 is a sectional view taken in line VI-VI in FIG. 3.
Figure 7:
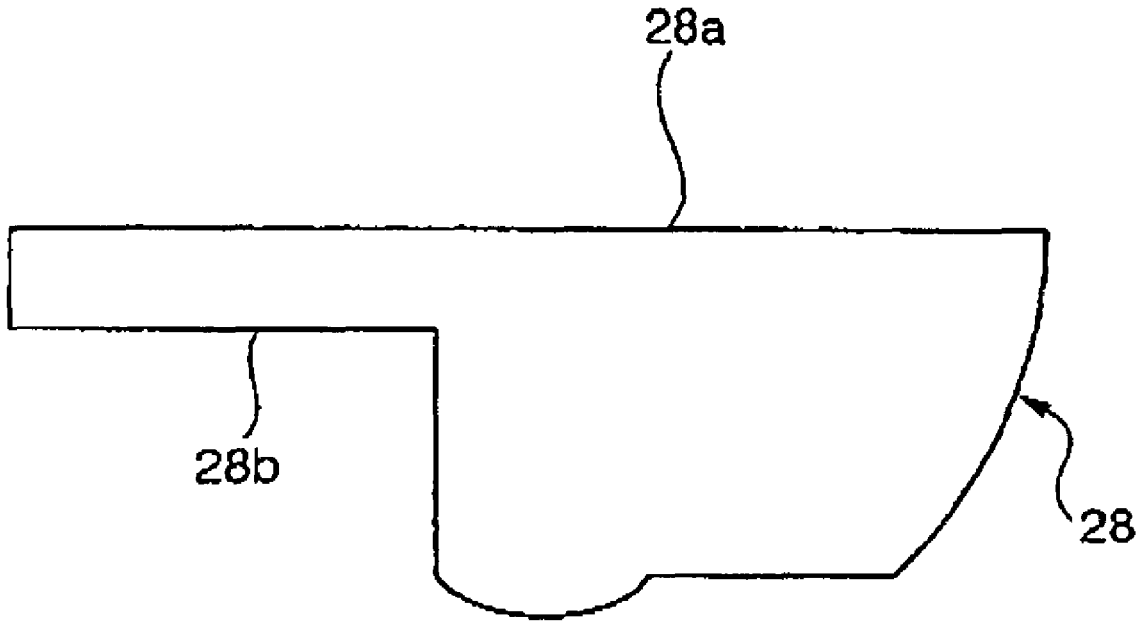
FIG. 7 is a front view of the shade attached to the vehicle headlamp.

FIG. 1 is a perspective view of the overall appearance of a vehicle headlamp according to an embodiment of the present invention. FIG. 2 is a top view of the vehicle headlamp according to the embodiment of the present invention. FIG. 3 is a front view of the vehicle headlamp according to the embodiment of the present invention. FIG. 4 is a side view of the vehicle headlamp according to the embodiment of the present invention. FIG. 5 is a sectional view taken in line V-V in FIG. 2. FIG. 6 is a sectional view taken in line VI-VI in FIG. 3. FIG. 7 is a front view of the shade attached to the vehicle headlamp according to the embodiment of the present invention. Incidentally, in FIGS. 1 to 4, the shape of unseen members hidden by the members on the forward side are indicated in broken line.

A vehicle headlamp 10 according to this embodiment is arranged as a lamp unit 20 within a lamp chamber formed by a lamp body (not shown) and a light permeable cover attached to cover a front opening of the lamp body.

The lamp unit 20 is a projector type lamp unit provided with plural reflecting members. As shown in FIGS. 1 to 6, the lamp unit 20 includes a first main reflector 24 and a second main reflector 26 which are divided upper and lower parts, and first to sixth sub-reflectors 31 to 38 arranged around the first main reflector 24 and second main reflector 26.

First, the first main reflector 24 will be explained.

The first main reflector 24, as seen from FIG. 5, is a reflecting member having a reflecting face 24*a* on the inside and forward projecting light which serves as main distributed light of the vehicle use lamp 10. The reflecting face 24*a* has a substantially elliptical shape contributing to light condensing as a vertical sectional shape and a free curved shape contributing to light diffusion in the width direction as a horizontal sectional shape. The first main reflector 24 corresponds to an upper half part which is horizontally cut below the central axis of the reflecting face 24*a*, and forms a semi-domed shape.

The first main reflector 24 has an opening 24*b* formed on the rear side along the central axis of the reflecting face 24*a*. A light source bulb 22 is firmly inserted in the opening 24*b* in parallel to the central axis of the reflecting face 24*a* from the rear side of the main reflector 24. Thus, the first main reflector 24 is attached to cover the top and side of the light source bulb 22. Incidentally, in this embodiment, the first main reflector 24 is arranged so that the central axis of the reflecting face 24*a* constitutes an optical axis Ax of the vehicle headlamp 10 which extends in the longitudinal direction of the vehicle. A front side opening edge 24*c* of the first main reflector 24 is oriented to the forward side of the vehicle (see FIG. 6).

The light source bulb 22 may be a discharge bulb such as a metal halide bulb. Light is emitted from a light source 22*a* which is constructed of a discharging/emitting portion of the discharge bulb. The light source bulb 22 is arranged in the vicinity of a first focal point P1 of the first main reflector 24 arranged on the optical axis Ax. The light which is emitted from the light source bulb 22 and incident on the reflecting face 24*a* of the first main reflector 24 is reflected toward a second focal point P2 of the first main reflector 24 which is also arranged on the optical axis Ax.

On the forward side in the optical axis direction of the first main reflector 24, a shade 28 and a projection lens 29 are arranged.

The shade 28 is a cutting member for cutting a part of the light which is emitted from the light source 22*a* of the light source bulb 22 and reflected by the reflecting face 24*a* of the first main reflector 24. The upper edge 28*a* is arranged at a position slightly behind the second focal point of the first main reflector 24 in the longitudinal direction of the vehicle so that the longitudinal direction of the shade 28 is orthogonal to the optical axis Ax. The upper edge 28*a* of the shade 28 has a shape corresponding to a distributed light pattern projected forward so that a part of the light going toward the second focal point P2 is cut according to the shape of the upper edge 28*a*.

The projection lens 29 is a convex lens arranged in front of the shade 28, which has a convex portion 29*a* formed on the front side and a flat incident face 29*b* formed on the rear side so as to be vertical to the optical axis Ax. The rear focal point of the projection lens 29 is located in vicinity of the second focal point of the first main reflector 24. The projection lens 29 forward projects, as nearly parallel rays of light, the light from the first main reflector 24 which has not been cut by the shade 28 but passed the shade 28.

Next, the second main reflector 26 will be explained below.

The second main reflector 26 is a reflecting member arranged below the first main reflector 24 and having a reflecting face 26*a* on the inside. The reflecting face 26*a* has a substantially parabolic shape as a vertical sectional shape and a free curved shape contributing to light diffusion in the width direction as a horizontal sectional shape. The second main reflector 26 corresponds to a lower half part which is horizontally cut below the central axis of the reflecting face 26*a*, and forms a semi-domed shape. The central axis of the reflecting face 26*a* of the second main reflector 26 is located to form a certain angle with the reflecting face 24*a* of the first main reflector 24. Thus, the second main reflector 26 has an opening edge 26*b* oriented aslant rightward on the forward side of the vehicle (see FIG. 6).

The second main reflector 26 is located below the light source 22*a*, and the focal point of the second main reflector 26 is located so as to substantially agree with the light source 22*a* of the light source bulb 22. Thus, the second main reflector 26 forward reflects the light emitted from the light source 22*a* by the reflecting face 26*a*. Now, in front of an opening edge 26*b* of the second main reflector 26, the shade 28 is arranged. And, as seen from FIG. 7, the shade 28 has a recess 28*b* formed not to cut the light from the second main reflector 26. The light reflected by the reflecting face 26*a* of the second main reflector 26 is projected forward through the recess 28*b*.

Next, the first to sixth sub-reflectors 31 to 38 will be explained in sequence.

The first sub-reflector 31 is a reflecting member arranged above the first main reflector 24 and equipped with a reflecting face 31*a* having a substantially parabolic shape as a vertical sectional shape and a free curved shape contributing to light diffusion in the width direction as a horizontal sectional shape. The reflecting face 31*a* of the first sub-reflector 31 is located so that its focal point substantially agrees with the light source 22*a*, and forward reflects the light emitted aslant upward on the forward side from the light source 22*a*, which is projected forward as nearly parallel rays of light. As seen from FIGS. 1 and 2, the first main reflector 24 located between the first sub-reflector 31 and the light source 22*a* has a recess 24*d* formed not to hinder the incidence of light on the first sub-reflector 31 from the light source 22*a*. The light emitted from the light source 24*a* is incident on the first sub-reflector 31 through the recess 24*d*.

The second sub-reflector 32 is a reflecting member arranged below the first main reflector 24 and equipped with a reflecting face 32*a* having a substantially parabolic shape as a vertical sectional shape and a free curved shape contributing to light diffusion in the width direction as a horizontal sectional shape. The reflecting face 32*a* of the second sub-reflector 32 is located so that its focal point substantially agrees with the light source 22*a*, and forward reflects, as nearly parallel rays of light, the light emitted aslant downward on the forward side from the light source 22*a*. As seen from FIG. 4, the second main reflector 26 located between the second sub-reflector 32 and the light source 22*a* has a recess 26*c* formed not to hinder the incidence of light on the second sub-reflector 32 from the light source 22*a*. The light emitted from the light source 24*a* is incident on the second sub-reflector 32 through the recess 26*c*.

The right third sub-reflector 33 is a reflecting member arranged on the forward right side of the first main reflector 24 and equipped with a reflecting face 33*a* having a substantially rotary elliptical shape. The reflecting face 33*a* of the right third sub-reflector 33 is located so that its focal point substantially agrees with the light source 22*a*, and rearward reflects the light emitted rightward on the forward side from the light source 22*a*.

The right fourth sub-reflector 34 is a reflecting member arranged right-aside of the first main reflector 24 and equipped with a reflecting face 34*a* having a substantially parabolic shape as a vertical sectional shape and a free curved shape contributing to light diffusion in the width direction as a horizontal sectional shape. The reflecting face 34*a* of the right third sub-reflector 34 is located so that its focal point substantially agrees with the second focal point P3 of the right third sub-reflector 33, and reflects the light incident from the reflecting face 33*a* of the right third sub-reflector 33, which is projected forward as nearly parallel rays of light.

The left third sub-reflector 35 is a reflecting member arranged on the forward left side of the first main reflector 24 and equipped with a reflecting face 35*a* having a substantially rotary elliptical shape. The reflecting face 35*a* of the left third sub-reflector 35 is located so that its focal point substantially agrees with the light source 22*a*, and reflects the light emitted leftward on the forward side from the light source 22*a* toward the vicinity of the second focal point P4 on the rearward side.

The left fourth sub-reflector 36 is a reflecting member arranged left-aside of the first main reflector 24 and equipped with a reflecting face 36*a* having a substantially parabolic shape as a vertical sectional shape and a free curved shape contributing to light diffusion in the width direction as a horizontal sectional shape. The reflecting face 36*a* of the left fourth sub-reflector 36 is located so that its focal point substantially agrees with the second focal point P4 of the left third sub-reflector 35, and reflects the light incident from the reflecting face 35*a* of the left third sub-reflector 35, which is projected forward as nearly parallel rays of light.

Incidentally, the optical system formed by the right third sub-reflector 33 and the right fourth sub-reflector 34 and the optical system formed by the left third sub-reflector 35 and the left fourth sub-reflector 36 are different in their left and right locating positions and projecting regions, but their basic arrangements are equivalent except for the difference in their left and right arranging positions. Therefore, in this specification, the right third sub-reflector 33 and left third sub-reflector 35 are generally termed "third sub-reflector" and the left third sub-reflector 34 and left fourth sub-reflector 36 are generally termed "fourth sub-reflector".

The fifth sub-reflector 37 is a reflecting member arranged below the first sub-reflector 31 and extended to the top of the opening edge 24*c* on the forward side of the first main reflector 24, and having a reflecting face 37 of a substantially rotary elliptical shape. The reflecting face 37*a* of the fifth sub-reflector 37 is located so that its first focal point substantially agrees with the light source 22*a*, and reflects the light emitted upward on the forward side from the light source 22*a* toward the vicinity of the second focal point P5 located below.

The sixth sub-reflector 38 is a reflecting member arranged in front of the second main reflector 26 and equipped with a reflecting face 38*a* having a substantially parabolic shape as a vertical sectional shape and a free curved shape contributing to light diffusion in the width direction as a horizontal sectional shape. The reflecting face 38*a* of the sixth sub-reflector 38 is located so that its focal point substantially agrees with the second focal point P5 of the fifth sub-reflector 37 and reflects the light incident from the reflecting face 38*a* of the sixth sub-reflector 38 which is projected forward. The central axis of the reflecting face 38*a* of the sixth sub-reflector 38 is located to form a certain angle with the optical axis Ax so that the light reflected from the reflecting face 38*a* its projected aslant sideward on the forward side of the vehicle.

Next, referring to FIGS. 8 to 10, a concrete explanation will be given of the optical path through the first main reflector 24, second main reflector 26 and first to sixth sub-reflectors 31 to 38 and a distributed light pattern projected.

Figure 8:
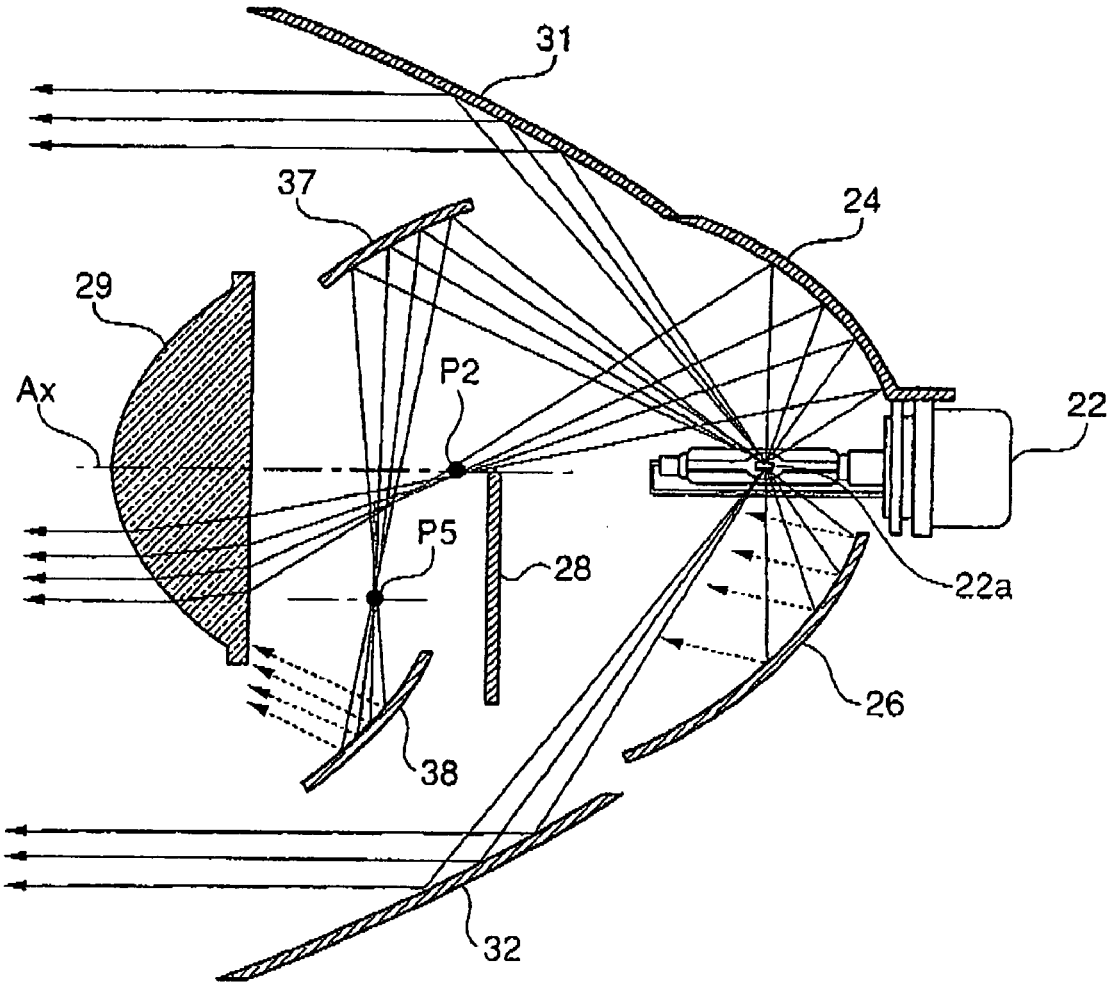
FIG. 8 is an optical path diagram in which rays of light are described in FIG. 5.

FIG. 8 is an optical path diagram in which rays of light are described in FIG. 5. FIG. 9 is an optical path diagram in which rays of light are described in FIG. 6. FIG. 10 is a schematic diagram showing distributed light patterns formed by the vehicle headlamp according to this embodiment.

First, an explanation will be given on the first main reflector 26.

Figure 9:
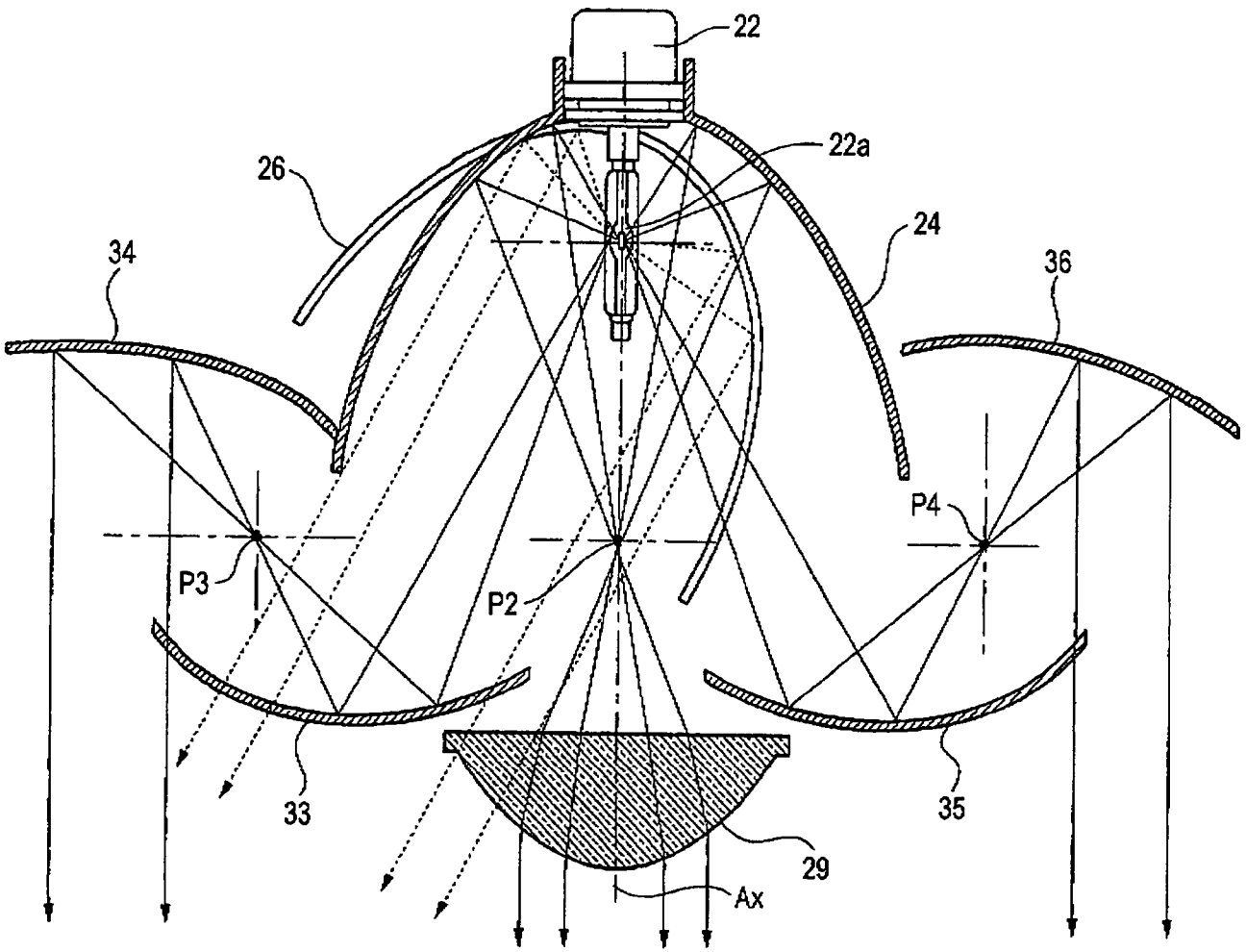
FIG. 9 is an optical path diagram in which rays of light are described in FIG. 6.

As seen from FIGS. 8 and 9, the light which is emitted from the light source 22*a* and incident on the first main reflector 24 is reflected toward the optical axis Ax by the reflecting face 24*a* of the first main reflector 24 and collected at the vicinity of the second focal point P2 of the first main reflector 24. Now, a part of the reflected light is cut according to the shape of the upper edge 28*a* of the shade 28, and the light not cut is incident on the projection lens 29 through the vicinity of the second focal point P2. The light made as parallel rays of light by the projection lens 29 is projected forward.

Figure 10:
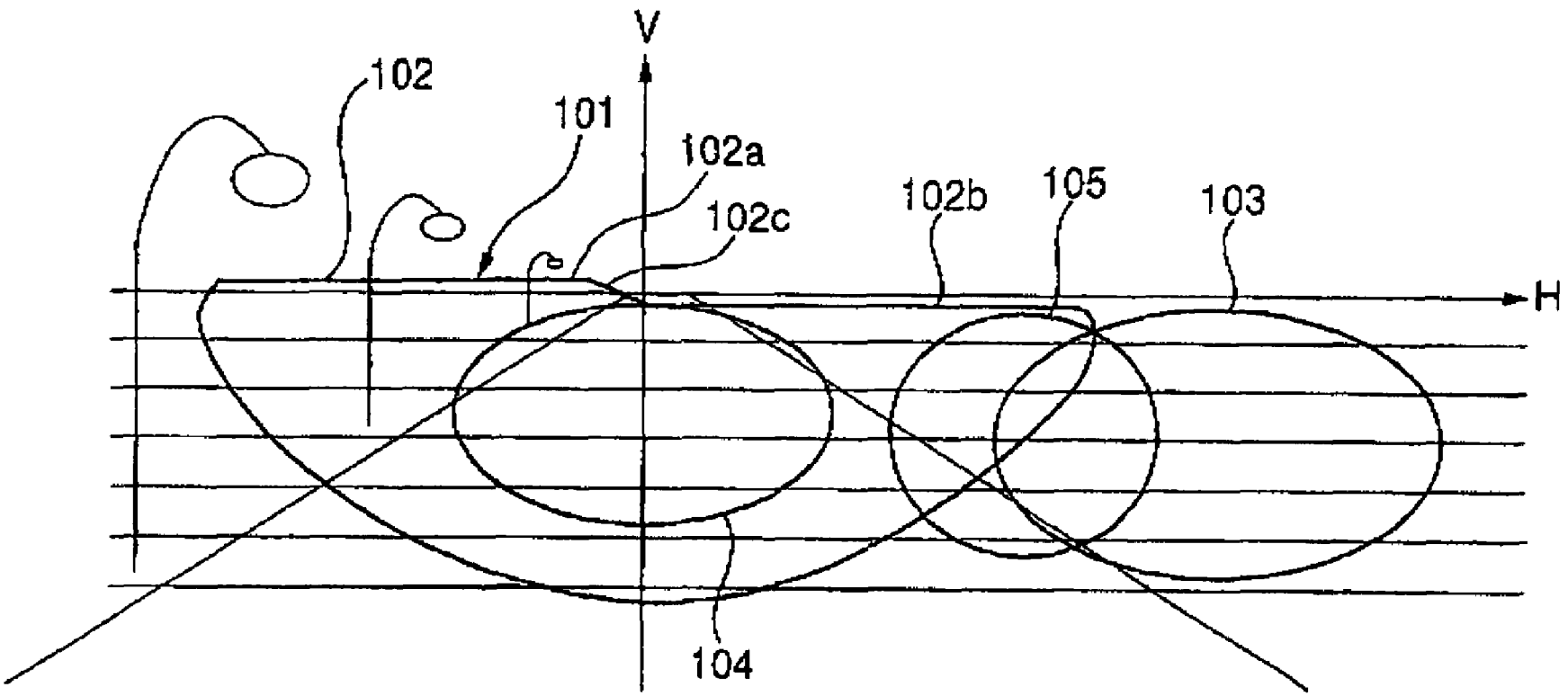
FIG. 10 is a schematic diagram showing distributed light patterns formed by the vehicle.

As seen from FIG. 10, the light projected forward via the first main reflector 24 forms a basic distributed light pattern 101 with a cut-off line 102 on the upper end. The cut-off line 102 has a shape formed when the shape of the upper edge of the shade 28 is inverted upside down and left and right. In this embodiment, the horizontal line 102*a* on the left side in the forward direction of the vehicle is connected to the horizontal line 102*b* on the right side in the forward direction of the vehicle by a slope 102*c*. The horizontal line 102*a* is located at a higher position than the horizontal line 102*b* in their horizontal height.

Next, an explanation will be given on the second main reflector 26.

As seen from FIGS. 8 and 9, the light which is emitted from the light source 22*a* and incident on the second main reflector 26 is reflected toward the direction inclined rightward in the forward direction of the vehicle from the optical axis Ax by the reflecting face 26*a* of the second main reflector 26. The reflected light passes below the shade 28 and is projected forward as rays of light (indicated by broken line in FIG. 9).

As seen from FIG. 10, the light projected forward via the second main reflector 26 forms a first auxiliary distributed light pattern 103 which illuminates a side region (right region in FIG. 10) not illuminated by the basic distributed light pattern 101. This first auxiliary distributed light pattern 103 gives an advantage of increasing the brightness of the side region to improve the side visibility of the vehicle.

Generally, in the projector type of vehicle headlamp equipped with a reflector having a semi-elliptical spherical shape, the light incident on the lower half part of the reflector located at the position of the second main reflector 26 will be cut by the shade 28, and hence cannot be taken out as effective light. However, according to this embodiment, the central axis of the second main reflector 26 is located in a direction inclined from that of the first main reflector 24 so that the light collected in a different direction is projected. Thus, the light can be projected forward as the effective light.

Next, an explanation will be given on the first sub-reflector 31.

As seen from FIG. 8, the light emitted upward on the forward side of the vehicle from the light source 22*a* is incident on the first sub-reflector 31 and reflected by the reflecting face 31*a* of the first sub-reflector 31. The reflected light is projected forward as nearly parallel rays of light. As seen from FIG. 10, the light projected forward via the first sub-reflector 31 is superposed on the basic distributed light pattern 101 to form a second auxiliary distributed light pattern 104 which increases the light intensity of the area (so-called hot zone) beneath the cut-off line 102 and in the vicinity of the center of the basic distributed pattern 101. This second auxiliary distributed light pattern 104 can increase the far distance visibility by increasing the light intensity of the hot zone of the basic distributed light pattern 101.

Next, an explanation will be given on the second sub-reflector 32.

As seen from FIG. 8, the light emitted downward on the forward side of the vehicle from the light source 22*a* is incident on the second sub-reflector 32 and reflected by the reflecting face 32*a* of the second sub-reflector 32. The reflected light is projected forward as parallel rays of light. As seen from FIG. 10, the light projected forward via the second sub-reflector 32 is superposed on the basic distributed light pattern 101 to form the second auxiliary distributed light pattern 104 which increases the light intensity of the area (so-called hot zone) in the vicinity of the center of the basic distributed pattern 101. Thus, the second sub-reflector 32 contributes to illuminate the same area as that for the first sub-reflector 31.

In the general projector type of vehicle headlamp, the end of the main reflector is often extended into an area where the first sub-reflector 31 and the second sub-reflector 32 are arranged. In this case, the light reflected to the vicinity of the end of the main reflector is difficult to be projected forward through the projection lens. In many case, the reflected light is not projected but results in the light scattered within the lamp unit. On the other hand, in accordance with this embodiment, such light is collected by the first sub-reflector 31 and the second sub-reflector 32 so that it is projected forward. Thus, the light emitted from the light source 22*a* can be effectively used as effective light.

Next, an explanation will be given on the right third sub-reflector 33 and right fourth sub-reflector 34 and the left third sub-reflector 35 and left fourth sub-reflector 36.

As seen from FIG. 9, the light emitted rightward on the forward side of the vehicle from the light source 22*a* is reflected rearward by the right third sub-reflector 33, and is incident on the right fourth sub-reflector 34 via the vicinity of the second focal point P3 of the right third sub-reflector 33. The light is reflected by the right fourth sub-reflector 34 so that it is projected forward nearly as parallel rays of light.

Likewise, the light emitted leftward on the forward side of the vehicle from the light source 22*a* is reflected rearward by the left third sub-reflector 35, and is incident on the left fourth sub-reflector 36 via the vicinity of the second focal point P4 of the left third sub-reflector 35. The light is reflected by the left fourth sub-reflector 36 so that it is projected forward nearly as parallel rays of light.

As seen from FIG. 10, the light projected forward via these right fourth sub-reflector 34 and left fourth sub-reflector 36 is superposed on the basic distributed light pattern 101 to form the second auxiliary distributed light pattern 104 which increases the light intensity of the area (so-called hot zone) in the vicinity of the center of the basic distributed pattern 101. Thus, the right fourth sub-reflector 34 and the left fourth sub-reflector 36 contribute to illuminate the same areas as that for the first and second sub-reflectors 31 and 32.

In the general projector type of vehicle headlamp, a lens holder is often provided in the area where the right third sub-reflector 33 and left third sub-reflector 35 are arranged. In this case, in many cases, the light incident on the inner periphery of the lens holder is not projected forward but results in the light scattered within the lamp unit. On the other hand, in accordance with this embodiment, such light is reflected rearward by the right third sub-reflector 33 and left third sub-reflector 35 and further reflected by the right fourth sub-reflector 34 and left fourth sub-reflector 36 so that it is forward collected and projected. Thus, the light emitted from the light source 22*a* can be effectively used as effective light.

Next, an explanation will be given on the fifth sub-reflector 37 and the six sub-reflector 38.

As seen from FIG. 8, the light emitted upward on the forward side of the vehicle from the light source 22*a* is reflected downward by the fifth sub-reflector 37. The light is incident on the sixth sub-reflector 38 via the vicinity of the second focal point P5 of the fifth sub-reflector 37 and reflected by the sixth sub-reflector 38. The light reflected from the reflecting face 38*a* of the sixth sub-reflector 38 is projected aslant sideward on the forward side of the vehicle.

As seen from FIG. 10, the light projected forward via the fifth sub-reflector 37 and sixth sub-reflector 38 forms a third auxiliary distributed light pattern 105 overlapping both the basic distributed light pattern 101 and first auxiliary distributed light pattern 103. The third auxiliary distributed light pattern 105 illuminates the side of the basic distributed light pattern 101 to improve the side visibility and continuously connect the basic distributed light pattern 101 and first auxiliary distributed light pattern 103 so that a dark zone is not formed between the basic distributed light pattern 101 and the first distributed light pattern 103.

In the general projector type of vehicle headlamp, the lens holder is often provided in the area where the fifth sub-reflector 37 is arranged. In this case, in many cases, the light incident on the inner periphery of the lens holder is not projected forward but results in the light scattered within the lamp unit. On the other hand, in accordance with this embodiment, such light is reflected downward by the fifth sub-reflector 37 and then reflected by the sixth sub-reflector 38 so that it is forward collected and projected. Thus, the light emitted from the light source 22*a* can be effectively used as effective light.

As described above, in the vehicle headlamp 10 according to this embodiment, the second main reflector 26 and plural sub-reflectors 31 to 38 are arranged around the first main reflector 24. In accordance with such a configuration, the light not projected forward as the lost light in the conventional projector type vehicle headlamp can be projected as effective light on the forward side of the vehicle. Thus, without improving the output of the light source 22*a*, the output of the vehicle headlamp can be increased, thereby providing a large light quantity type of vehicle headlamp.

Incidentally, in this embodiment, the second main reflector 26 projects light right-sideward to form the first auxiliary distributed light pattern 103; the first to left fourth sub-reflectors 31 to 36 project light forward of the vehicle to form the second auxiliary distributed light pattern 104; and the fifth to sixth sub-reflectors 37, 38 project light between the first auxiliary distributed light pattern 103 and second auxiliary light distributed light pattern 104 to form the third auxiliary distributed light pattern 105. However, the manner of forming the distributed light patterns should not be limited to this embodiment, but according to an objective distributed light pattern, the light projecting directions of the second main reflector 26 and first to sixth sub-reflectors 31 to 38 may be changed as required.

Further, in this embodiment, the second main reflector 26 and first to sixth sub-reflectors 31 to 38 project light forward not through the projection lens. However, without being limited to such a configuration, by forming all the reflecting faces in an elliptical shape and arranging the shade and projection lens so as to correspond to the single focal point of the elliptical shape, the auxiliary distributed light pattern having the cut-off line may be projected forward.

Further, in this embodiment, the second main reflector 26 and first to sixth sub-reflectors 31 to 38 are fixed. However, without being limited to such a configuration, the orientation of the reflecting faces may be changed by various driving mechanisms so that the zone to be illuminated changed is changed as circumstances demand.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

an optical axis extending in a longitudinal direction of the vehicle;

a light source for emitting light;

a first main reflector arranged above the light source, for reflecting the light emitted from the light source toward the optical axis;

a second main reflector arranged below the light source, for reflecting the light emitted from the light source toward a direction different from the optical axis;

a shade for cutting a part of the light reflected by the first main reflector to form a cut-off line;

a projection lens arranged in front of the first main reflector, for forward projecting the light having passed the shade; and a first sub-reflector arranged above the first main reflector, for forward reflecting the light emitted from the light source.

2. The vehicle headlamp according to claim 1, further comprising:

a second sub-reflector arranged below the second main reflector, for forward reflecting the light emitted from the light source.

3. A vehicle headlamp comprising:

an optical axis extending in a longitudinal direction of the vehicle;

a light source for emitting light;

a first main reflector arranged above the light source, for reflecting the light emitted from the light source toward the optical axis;

a second main reflector arranged below the light source, for reflecting the light emitted from the light source toward a direction different from the optical axis;

a shade for cutting a part of the light reflected by the first main reflector to form a cut-off line;

a projection lens arranged in front of the first main reflector, for forward projecting the light having passed the shade; and a first sub-reflector arranged on at least one of a forward right side and a forward left side of the first main reflector, for rearward reflecting the light emitted from the light source; and a second sub-reflector for forward reflecting the light reflected by the first sub-reflector.

4. The vehicle headlamp according to claim 1, further comprising:

a second sub-reflector arranged in front of the first main reflector, for downward reflecting the light emitted from the light source; and a third sub-reflector for forward reflecting the light reflected by the second sub-reflector.

5. A vehicle headlamp comprising:

an optical axis extending in a longitudinal direction of the vehicle;

a light source for emitting light;

a first main reflector arranged above the light source, for reflecting the light emitted from the light source toward the optical axis;

a second main reflector arranged below the light source, for reflecting the light emitted from the light source toward a direction different from the optical axis;

a shade for cutting a part of the light reflected by the first main reflector to form a cut-off line;

a projection lens arranged in front of the first main reflector, for forward projecting the light having passed the shade; and a first sub-reflector arranged above the first main reflector, for forward reflecting the light emitted from the light source;

a second sub-reflector arranged below the second main reflector, for forward reflecting the light emitted from the light source;

a third sub-reflector arranged on at least one of the forward right side and forward left side of the first main reflector, for rearward reflecting the light emitted from the light source;

a fourth sub-reflector for forward reflecting the light reflected by the third sub-reflector;

a fifth sub-reflector arranged in front of the first main reflector, for downward reflecting the light emitted from the light source; and a sixth sub-reflector for forward reflecting the light reflected by the fifth sub-reflector.

6. The vehicle headlamp according to claim 5, wherein the first main reflector includes a reflecting face with a substantially elliptical shape as a vertical sectional shape and a free curved shape as a horizontal sectional shape;

the light source is arranged in vicinity of a first focal point of the first main reflector;

the light emitted from the light source and incident on the reflecting face of the first main reflector is reflected toward a second focal point of the first main reflector;

the rear focal point of the projection lens is located in vicinity of the second focal point of the first main reflector;

the second main reflector includes a reflecting face with a substantially parabolic shape as a vertical sectional shape and a free curved shape as a horizontal sectional shape.

the first sub-reflector includes a reflecting face having a substantially parabolic shape as a vertical sectional shape and a free curved shape as a horizontal sectional shape;

the second sub-reflector includes a reflecting face having a substantially parabolic shape as a vertical sectional shape and a free curved shape as a horizontal sectional shape;

the third sub-reflector includes a reflecting face having a substantially rotary elliptical shape;

the fourth sub-reflector includes a reflecting face having a substantially parabolic shape as a vertical sectional shape and a free curved shape as a horizontal sectional shape;

the fifth sub-reflector includes a reflecting face of a substantially rotary elliptical shape; and the sixth sub-reflector includes a reflecting face having a substantially parabolic shape as a vertical sectional shape and a free curved shape as a horizontal sectional shape.

* * * * *